US006402939B1

(12) United States Patent
Yen et al.

(10) Patent No.: US 6,402,939 B1
(45) Date of Patent: Jun. 11, 2002

(54) OXIDATIVE DESULFURIZATION OF FOSSIL FUELS WITH ULTRASOUND

(75) Inventors: Teh Fu Yen, Altadena; Hai Mei, Los Angeles; Steve Hung-Mou Lu, Arcadia, all of CA (US)

(73) Assignee: Sulphco, Inc., Reno, NV (US)

( * ) Notice: Subject to any disclaimer, the term of this patent is extended or adjusted under 35 U.S.C. 154(b) by 0 days.

(21) Appl. No.: 09/676,260

(22) Filed: Sep. 28, 2000

(51) Int. Cl.[7] ..... C10G 27/04; C10G 27/12

(52) U.S. Cl. ..... 208/196; 208/208 R; 208/240; 208/243; 208/244; 208/245; 208/246; 208/307; 204/154.15; 204/157.62; 204/158.21

(58) Field of Search ..... 208/196, 208 R, 208/240, 243, 244, 245, 246, 307; 204/157.15, 157.62, 158.21

(56) References Cited

U.S. PATENT DOCUMENTS

| | | | | |
|---|---|---|---|---|
| 2,578,377 A | * | 12/1951 | Smith | 208/158 |
| 2,593,761 A | * | 4/1952 | Johnstone | 208/191 |
| 2,742,408 A | * | 4/1956 | La Porte | 208/143 |
| 2,749,284 A | * | 6/1956 | Noble | 208/196 |
| 3,816,301 A | * | 6/1974 | Sorgenti | 208/208 R |
| 4,314,902 A | * | 2/1982 | Bouk et al. | 208/254 R |
| 4,369,100 A | * | 1/1983 | Sawyer | 204/157.42 |
| 4,391,608 A | * | 7/1983 | Dondelewski | 44/624 |
| 4,514,286 A | * | 4/1985 | Wang et al. | 208/196 |
| 4,548,708 A | * | 10/1985 | Schwarzer et al. | 208/196 |
| 4,725,287 A | | 2/1988 | Gregoli et al. | |
| 4,891,131 A | | 1/1990 | Sadehgi et al. | |
| 4,978,365 A | | 12/1990 | Gregoli et al. | |
| 5,000,872 A | | 3/1991 | Olah | |
| 5,017,281 A | | 5/1991 | Sadeghi et al. | |
| 5,110,443 A | | 5/1992 | Gregoli et al. | |
| 5,139,679 A | | 8/1992 | Pan et al. | |
| 5,156,114 A | | 10/1992 | Gunnerman | |
| 5,387,523 A | | 2/1995 | Monticello | |
| 5,496,729 A | | 3/1996 | Monticello | |
| RE35,237 E | | 5/1996 | Gunnerman | |
| 5,824,214 A | | 10/1998 | Paul et al. | |
| 5,904,839 A | | 5/1999 | Brons | |
| 5,961,820 A | | 10/1999 | Jeanblanc et al. | |
| 5,985,650 A | | 11/1999 | Squires et al. | |

FOREIGN PATENT DOCUMENTS

| | | | |
|---|---|---|---|
| EP | 0 482 841 | * | 4/1992 |
| WO | WO/00/15734 | | 3/2000 |

OTHER PUBLICATIONS

Attar and Corcoran, Desulfurization of organic sulfur compounds by selective oxidation. 1. Regenerable and Nonregenerable oxygen carriers, *Ind. Eng. Chem. Prod. Res. Dev.* (1978) 17(2): 102–109.

Curci et al., "On the oxidation of organic sulphoxides by potassium t–butyl peroxide," *J. Chem. Soc., Perkin Trans. II* (1978) 6: 603–607.

Lin and Yen, "An upgrading process through cavitation and surfactant," *Energy & Fuels* (1993) 7(1): 111–118.

Ma et al., " . . . desulfurization reactivities of various sulfur compounds in fossil fuel," *Ind. Eng. Chem. Res.* (1994) 33: 218–222.

Ma et al., "Hydrodesulfurization Reactivities of Various Sulfur Compounds in Vacuum Gas Oil," *Ind. Eng. Chem. Res.*, (1996) 35: 2487–2494.

Tu and Yen, "The feasibility studies for radical–induced decomposition and demetalation of metalloporphyrins by ultrasonication," *Energy & Fuels* (12000) 14: 1168–1175.

Zannikos et al., "Desulfurization of petroleum fractions by oxidation and solvent extraction," *Fuel Processing technology* (1995) 42: 35–45.

* cited by examiner

*Primary Examiner*—Walter D. Griffin
(74) *Attorney, Agent, or Firm*—Townsend and Townsend and Crew LLP

(57) ABSTRACT

Fossil fuels are combined with a hydroperoxide in an aqueous-organic medium and subjected to ultrasound, with the effect of oxidizing the sulfur compounds in the fuels to sulfones. Due to their high polarity, the sulfones thus formed are readily removed from the fuels by polar extraction. The process is thus highly effective in removing sulfur compounds from the fuels.

33 Claims, 4 Drawing Sheets

A Dibenzothiophene sulfone
B (C1)-methyl dibenzothiophene sulfone
C (C2)-dimethyl dibenzothiophene sulfone
D (C3)-trimethyl dibenzothiophene sulfone
E (C4)-tetramethyl dibenzothiophene sulfone A (C1)-methyl dibenzothiophene sulfone
B (C2)-dimethyl dibenzothiophene sulfone
C (C3)-trimethyl dibenzothiophene sulfone

OXIDATIVE DESULFURIZATION OF FOSSIL FUELS WITH ULTRASOUND

BACKGROUND OF THE INVENTION

1. Field of the Invention

This invention resides in the field of the desulfurization of petroleum and petroleum-based fuels.

2. Description of the Prior Art

While alternative sources of power are under development and in use in many parts of the world, fossil fuels remain the largest and most widely used source due to their high efficiency, proven performance, and relatively low prices. Fossil fuels take many forms, ranging from petroleum fractions to coal, tar sands, and shale oil, and their uses extend from consumer uses such as automotive engines and home heating to commercial uses such as boilers, furnaces, smelting units, and power plants.

A persistent problem in the processing and use of fossil fuels is the presence of sulfur, notably in the form of organic sulfur compounds. Sulfur has been implicated in the corrosion of pipeline, pumping, and refining equipment and in the premature failure of combustion engines. Sulfur is also responsible for the poisoning of catalysts used in the refining and combustion of fossil fuels. By poisoning the catalytic converters in automotive engines, sulfur is responsible in part for the emissions of oxides of nitrogen ($NO_x$) from diesel-powered trucks and buses. Sulfur is also responsible for the particulate (soot) emissions from trucks and buses since the traps used on these vehicles for controlling these emissions are quickly degraded by high-sulfur fuels. Perhaps the most notorious characteristic of sulfur compounds in fossil fuels is the conversion of the sulfur in these compounds to sulfur dioxide when the fuels are combusted. The release of sulfur dioxide to the atmosphere results in acid rain, a deposition of acid that is harmful to agriculture, wildlife, and human health. Ecosystems of various kinds are threatened with irreversible damage, as is the quality of life.

In response to these concerns, the Clean Air Act of 1964 was enacted, and various amendments, including those of 1990 and 1999, have imposed progressively more stringent requirements to reduce even further the amount of sulfur released to the atmosphere. In a recent action, the United States Environmental Protection Agency has lowered the sulfur standard for diesel fuel to 15 parts per million by weight (ppmw), effective in mid-2006, from the present standard of 500 ppmw. For reformulated gasoline, the current standard of 300 ppmw has been lowered to 30 ppmw, effective Jan. 1, 2004. Similar changes have been enacted in the European Union, which will enforce a limit of 50 ppmw on the sulfur limit for both gasoline and diesel fuel in the year 2005.

Because of these regulatory actions, the need for more effective desulfurization methods is always present. In addition to the difficulty in lowering sulfur emissions to meet the requirements, the petroleum industry also faces the increased production costs associated with sophisticated desulfurization methods and the unfavorable reactions of consumers and governments to increased prices. The costs associated with fossil fuels are some of the major factors affecting the world economy.

The most common method of desulfurization of fossil fuels is hydrodesulfurization, in which the fossil fuel is reacted with hydrogen gas at elevated temperature and high pressure in the presence of a costly catalyst. Organic sulfur is reduced by this reaction to gaseous $H_2S$, which is then oxidized to elemental sulfur by the Claus process. Unreacted $H_2S$ from the process is harmful, however, even in very small amounts. $H_2S$ has an extremely high acute toxicity, which has caused many deaths in the workplace and in areas of natural accumulation, and is hazardous to workers. These hazards present health risks in many types of industries, such as the gas, oil, chemical, geothermal energy, mining, drilling, and smelting industries. Even brief exposure to $H_2S$ at a concentration of 140 mg/m$^3$ causes conjunctivitis and keratitis, while exposures at 280 mg/m$^3$ and above can cause loss of consciousness, paralysis, and even death. $H_2S$ exposure has been implicated in disorders of the nervous system, and in cardiovascular, gastrointestinal, and ocular disorders. One of the difficulties with the new regulations is that when hydrodesulfurization is performed under the more stringent conditions needed to achieve the lower sulfur levels, there is an increased risk of hydrogen leaking through walls of the reactor.

In addition to its tendency to release $H_2S$ into the atmosphere, the hydrodesulfurization process has certain limitations in its ability to convert the variety of organic sulfur compounds that are present in fossil fuels. Among these compounds, mercaptans, thioethers, and disulfides are relatively easy to remove by the process. Other sulfur-bearing organic compounds however are less easy to remove and require harsher reaction conditions. These compounds include aromatic compounds, cyclic compounds, and condensed multicyclic compounds. Illustrative of these compounds are thiophene, benzothiophene, dibenzothiophene, other condensed-ring thiophenes, and various substituted analogs of these compounds. These compounds, which account for upwards of 40% of the total sulfur content of crude oils from the Middle East and upwards of 70% of the sulfur content of West Texas crude oil, are the most difficult to remove, and for this reason is commonly the focus of desulfurization studies. The reaction conditions needed to remove these compounds are so harsh that they cause degradation of the fuel itself, thereby lowering its quality.

SUMMARY OF THE INVENTION

It has now been discovered that organic sulfur compounds can be removed from a fossil (or petroleum-derived) fuel by a process that combines oxidative desulfurization with the use of ultrasound. The oxidative desulfurization is achieved by combining the fossil fuel with a hydroperoxide oxidizing agent in the presence of an aqueous fluid, and the ultrasound is applied to the resulting mixture to increase the reactivity of the species in the mixture. An indication of the unusually high effectiveness of the process is the observation that dibenzothiophene and related sulfur-bearing organic sulfides, which are the most refractory organic sulfur compounds in fossil fuels, are readily converted by this process to the corresponding sulfones under relatively modest conditions of temperature and pressure. The higher polarities of the sulfones relative to the sulfides render the sulfones readily susceptible to removal by conventional polarity-based separation processes. Thus, dibenzothiophenes and other sulfides of comparable or lesser resistance to oxidation are convertible by this process to their more polar sulfone analogs, without externally applied heat or pressure other than that which may be caused internally in a highly localized manner by the ultrasound.

An advantage of the process of this invention is that the oxidation is selective toward the conversion of sulfur-bearing compounds and occurs with no apparent change in the non-sulfur-bearing components of the fossil fuel. In addition, although both aqueous and organic phases remain in an emulsion form present throughout the progress of the reaction, the process can be performed to useful effect without the addition of a surface active agent. While not intending to be bound by any particular theory, it is believed that most fossil fuels contain native (i.e., naturally present) components that serve as surfactants. A still further advantage is that the conversion occurs in a very short period of time, i.e., considerably less than an hour, preferably less than twenty minutes, and in many cases less than ten minutes.

DETAILED DESCRIPTION OF THE INVENTION AND SPECIFIC EMBODIMENTS

Figure 1:
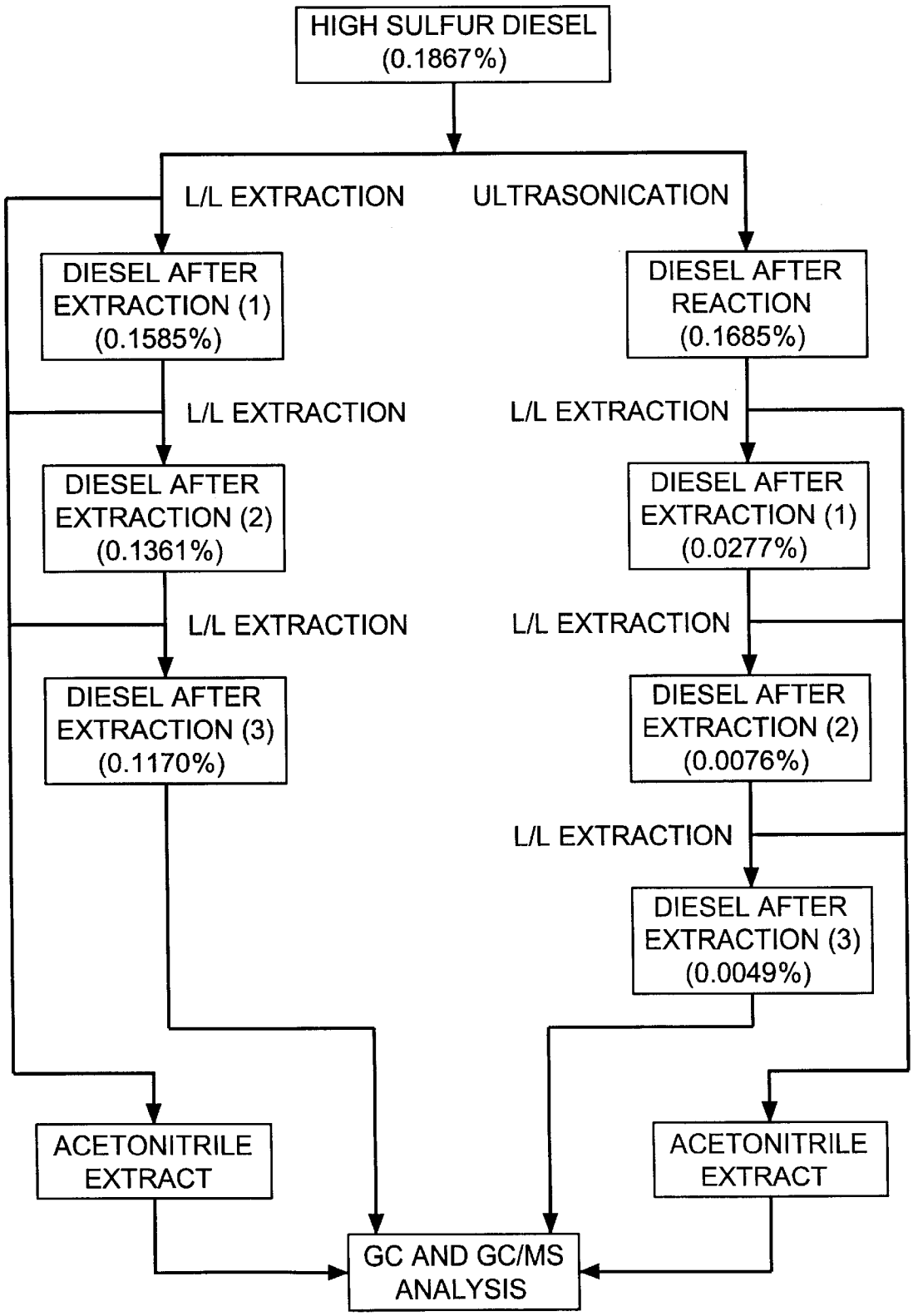
FIG. 1 is a schematic diagram of a desulfurization processes in accordance with the present invention for high-sulfur diesel.

The organic sulfur that is present as a naturally-occurring component of fossil (or petroleum-derived) fuels consists of a wide variety of compounds that are primarily hydrocarbons containing one or more sulfur atoms covalently bonded to the remainder of the molecular structure. There are many petroleum-derived compounds containing carbon, hydrogen and sulfur, and some of these compounds contain other heteroatoms as well. The hydrocarbon portions of these compounds may be aliphatic, aromatic, saturated, unsaturated, cyclic, fused cyclic, or otherwise, and the sulfur atoms may be included in the molecular structure as thiols, thioethers, sulfides, disulfides, and the like. Some of the most refractory of these compounds are sulfur-bearing heterocycles, both aromatic and non-aromatic, ranging from thiophene to fused structures such as substituted and unsubstituted benzothiophene and substituted and unsubstituted dibenzothiophene. The structures of some of these compounds (and the numbering schemes used in the nomenclature) are shown below.

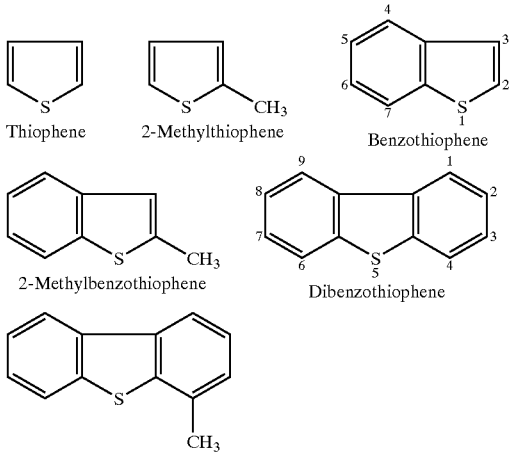

-continued

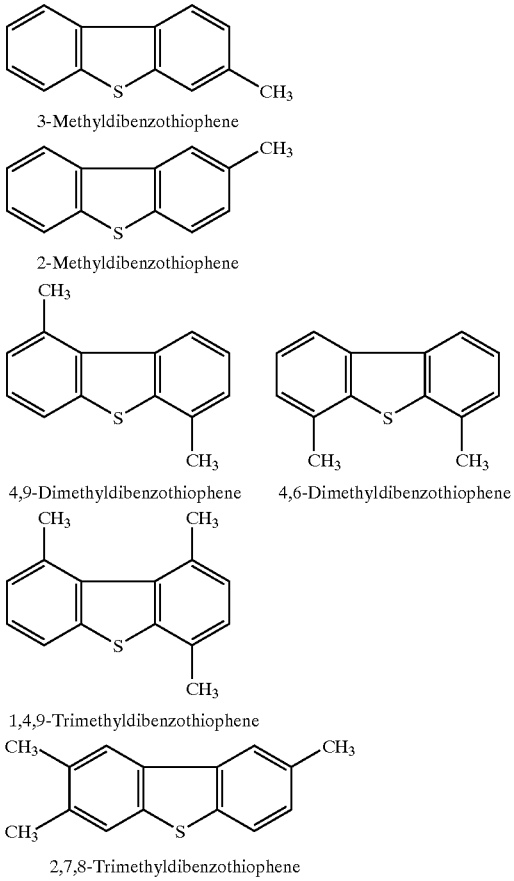

Other examples are analogs in which the methyl groups are replaced by ethyl or other lower alkyl or alkoxy groups or substituted alkyl groups such as hydroxyl-substituted groups.

The term "hydroperoxide" is used herein to denote a compound of the molecular structure

R—O—O—H in which R represents either a hydrogen atom or an organic or inorganic group. Examples of hydroperoxides in which R is an organic group are water-soluble hydroperoxides such as methyl hydroperoxide, ethyl hydroperoxide, isopropyl hydroperoxide, n-butyl hydroperoxide, sec-butyl hydroperoxide, tert-butyl hydroperoxide, 2-methoxy-2-propyl hydroperoxide, tert-amyl hydroperoxide, and cyclohexyl hydroperoxide. Examples of hydroperoxides in which R is an inorganic group are peroxonitrous acid, peroxophosphoric acid, and peroxosulfuric acid. Preferred hydroperoxides are hydrogen peroxide (in which R is a hydrogen atom) and tertiary-alkyl peroxides, notably tert-butyl peroxide.

The aqueous fluid that is combined with the fossil fuel and the hydroperoxide may be water or any aqueous solution. The relative amounts of liquid fossil fuel and water may vary, and although they may affect the efficiency of the process or the ease of handling the fluids, the relative amounts are not critical to this invention. In most cases, however, best results will be achieved when the volume ratio of fossil fuel to aqueous fluid is from about 1:1 to about 3:1, and preferably from about 1:1.5 to about 1:2.5.

The amount of hydroperoxide relative to the fossil fuel and the aqueous fluid can also be varied, and although the conversion rate may vary somewhat with the proportion of hydroperoxide, the actual proportion is not critical to the invention, and any excess amounts will be eliminated by the ultrasound. When the hydroperoxide is $H_2O_2$, best results will generally be achieved in most systems with an $H_2O_2$ concentration within the range of from about 1% to about 30% by volume (as $H_2O_2$) of the combined aqueous and organic phases, and preferably from about 2% to about 4%. For hydroperoxides other than $H_2O_2$, the preferred relative volumes will be those of equivalent molar amounts.

Sonic energy in accordance with this invention is applied by the use of ultrasonics, which are soundlike waves whose frequency is above the range of normal human hearing, i.e., above 20 kHz (20,000 cycles per second). Ultrasonic energy with frequencies as high as 10 gigahertz (10,000,000,000 cycles per second) has been generated, but for the purposes of this invention, useful results will be achieved with frequencies within the range of from about 20 kHz to about 200 kHz, and preferably within the range of from about 20 kHz to about 50 kHz. Ultrasonic waves can be generated from mechanical, electrical, electromagnetic, or thermal energy sources. The intensity of the sonic energy may also vary widely. For the purposes of this invention, best results will generally be achieved with an intensity ranging from about 30 watts/cm$^2$ to about 300 watts/cm$^2$, or preferably from about 50 watts/cm$^2$ to about 100 watts/cm$^2$. The typical electromagnetic source is a magnetostrictive transducer which converts magnetic energy into ultrasonic energy by applying a strong alternating magnetic field to certain metals, alloys and ferrites. The typical electrical source is a piezoelectric transducer, which uses natural or synthetic single crystals (such as quartz) or ceramics (such a barium titanate or lead zirconate) and applies an alternating electrical voltage across opposite faces of the crystal or ceramic to cause an alternating expansion and contraction of crystal or ceramic at the impressed frequency. Ultrasound has wide applications in such areas as cleaning for the electronics, automotive, aircraft, and precision instruments industries, flow metering for closed systems such as coolants in nuclear power plants or for blood flow in the vascular system, materials testing, machining, soldering and welding, electronics, agriculture, oceanography, and medical imaging. The various methods of producing and applying ultrasonic energy, and commercial suppliers of ultrasound equipment, are well known among those skilled in the use of ultrasound.

The duration of the exposure of the reaction system to ultrasound in accordance with this invention is not critical to the practice or to the success of the invention, and the optimal amount will vary according to the type of fuel being treated. An advantage of the invention however is that effective and useful results can be achieved with sonic energy exposure of a relatively short period of time, notably less than twenty minutes and in many cases less than ten minutes. The sonic energy can be applied to the reaction system in a batchwise manner or in a continuous manner in which case the exposure time is the residence time in a flow-through ultrasound chamber.

While not intending to be bound by any particular theory, it has been reported that the application of ultrasound to a liquid system produces cavitation in the liquid, i.e., the continuous formation and collapse of microscopic vacuum bubbles with extremely high localized temperatures and pressures. For example, it is believed that ultrasonic waves at a frequency of 45 kHz produce 90,000 formation-implosion sequences per second and localized temperatures on the order of 5,000° C. and pressures on the order of 4,500 psi. This causes extreme turbulence and intense mixing.

In certain embodiments of this invention, the reaction is performed in the presence of a phase transfer agent. A wide variety of phase transfer agents are known to be effective in accelerating reaction rates in systems that contain both aqueous and organic phases, and many of these agents can be used to beneficial effect in the present invention, Cationic, anionic and nonionic surfactants can function as phase transfer agents. The preferred phase transfer agents are cationic species, and preferred among these are quaternary ammonium salts, quaternary phosphonium salts, and crown ethers. Examples of quaternary ammonium salts are tetrabutyl ammonium bromide, tetrabutyl ammonium hydrogen sulfate, tributylmethyl ammonium chloride, benzyltrimethyl ammonium chloride, benzyltriethyl ammonium chloride, methyltricaprylyl ammonium chloride, dodecyltrimethyl ammonium bromide, tetraoctyl ammonium bromide, cetyltrimethyl ammonium chloride, and trimethyloctadecyl ammonium hydroxide. Quaternary ammonium halides are particularly preferred, and the most preferred are dodecyltrimethyl ammonium bromide and tetraoctyl ammonium bromide. The effective amount of phase transfer agent will be any amount that causes an increase in the rate at which the sulfides in the fossil fuel are converted to sulfones, the yield, or the selectivity for the reaction. In most cases, the effective amount will range from about 0.2 g of the agent per liter of the reaction medium to about 50 g of the agent per liter, and preferably from about 0.3 g per liter to about 3 g per liter.

In further embodiments of the invention, a metallic catalyst is included in the reaction system to regulate the activity of the hydroxyl radical produced by the hydroperoxide. Examples of such catalysts are Fenton catalysts (ferrous salts) and metal ion catalysts in general such as iron (II), iron (III), copper (I), copper (II), chromium (III), chromium (VI), molybdenum, tungsten, and vanadium ions. Of these, iron (II), iron (III), copper (II), and tungsten catalysts are preferred. For some systems, such as crude oil, Fenton-type catalysts are preferred, while for others, such as diesel and other systems where dibenzylthiophene is a prominent component, tungstates are preferred. Tungstates include tungstic acid, substituted tungstic acids such as phosphotungstic acid, and metal tungstates. The metallic catalyst when present will be used in a catalytically effective amount, which means any amount that will enhance the progress of the reaction toward the desired goal, which is the oxidation of the sulfides to sulfones. In most cases, the catalytically effective amount will range from about 1 mM to about 300 mM, and preferably from about 10 mM to about 100 mM.

The ultasound-assisted oxidation reaction generates heat and does not require the addition of heat from an external source. To maintain control over the reaction, it is preferable to draw heat from the reaction medium by using a coolant or cooling apparatus or mechanism. When cooling is achieved by immersing the ultrasound chamber in a coolant bath or circulating coolant, the coolant may be at a temperature of about 50° C. or less, preferably about 20° C. or less, and more preferably within the range of from about −5° C. to about 20° C. Suitable cooling methods or devices will be readily apparent to those skilled in the art.

Once the ultrasound is terminated, the product mixture will contain aqueous and organic phases, and the organic phase will contain the bulk of the sulfones produced by the oxidation reaction. The product mixture can be phase-separated prior to sulfone removal, or sulfone removal can be performed on the multiphase mixture without phase separation. Phase separation if desired can be accomplished by conventional means, preceded if necessary by breaking the emulsion caused by the ultasound. The breaking of the emulsion is also performed by conventional means. The various possibilities for methods of performing these procedures will be readily apparent to anyone skilled in the art of handling emulsions, and particularly oil-in-water emulsions.

With their increased polarity relative to the sulfides originally present in the fossil fuels, the sulfones produced by this invention are readily removable from either the aqueous phase, the organic phase, or both, by conventional methods of extracting polar species. The sulfones can be extracted by solid-liquid extraction using absorbents such as silica gel, activated alumina, polymeric resins, and zeolites. Alternatively, the sulfones can be extracted by liquid-liquid extraction using polar solvents such as dimethyl formamide, N-methylpyrrolidone, or acetonitrile. Other extraction media, both solid and liquid, will be readily apparent to those skilled in the art of extracting polar species.

The term "liquid fossil fuels" is used herein to denote any carbonaceous liquid that is derived from petroleum, coal, or any other naturally occurring material and that is used for energy generation for any kind of use, including industrial uses, commercial uses, governmental uses, and consumer uses. Included among these fuels are automotive fuels such as gasoline, diesel fuel, jet fuel, and rocket fuel, as well as petroleum residuum-based fuel oils including bunker fuels and residual fuels. Bunker fuels are heavy residual oils used as fuel by ships and industry and in large-scale heating installations. No. 6 fuel oil, which is also known as "Bunker C" fuel oil, is used in oil-fired power plants as the major fuel and is also used as a main propulsion fuel in deep draft vessels in the shipping industry. No. 4 fuel oil and No. 5 fuel oil are used to heat large buildings such as schools, apartment buildings, and office buildings, and large stationary marine engines. The heaviest fuel oil is the vacuum residuum from the fractional distillation, commonly referred to as "vacuum resid," with a boiling point of 565° C. and above, which is used as asphalt and coker feed. The present invention is useful in reducing the sulfur content of any of these fuels and fuel oils.

Since the reaction medium in which the oxidative desulfurization of this invention is performed is an emulsion, the invention is particularly adaptable to the preparation of emulsion fuels. Examples of such fuels are disclosed in U.S. Pat. No. 5,156,114, issued Oct. 20, 1992 to Rudolf W. Gunnerman, reissued on May 14, 1996 as Re 35,237, and co-pending U.S. patent application Ser. No. 09/081,867, filed May 20, 1998. The disclosures of these patents and this pending patent application are incorporated herein by reference for all legal purposes capable of being served thereby. The emulsion fuels consist of oil-in-water emulsions, and may be prepared directly from the reaction medium after ultrasound and extraction of the sulfones, by adding the additives that stabilize the emulsion.

The following examples are offered for purposes of illustration and are not intended to limit the scope of the invention.

EXAMPLE 1

This example illustrates the use of the process of the present invention for the removal of dibenzothiophene from a solution of dibenzothiophene in toluene and from crude oil, and the effects of varying certain parameters of the reaction system. The instruments and materials used were as follows:

Ultrasound generator:
- Supplier: Sonics & Materials, Inc., Newtown Conn., USA
- Model: VCX-600
- Power supply: net power output of 600 watts
- Frequency: 20 kHz
- Converter type: piezoelectric PZT; lead zirconate titanate crystals
- Probe type: ½-inch threaded-end ultrasound probe
- Intensity: up to 100 watts/cm$^2$ Sulfur analyzer:
- Supplier: Horiba Instruments, Inc., Knoxville, Tenn., USA
- Model: SLFA-20
- Detection limit: 20 ppm Gas chromatography: Hewlett Packard 5880A UV/Visible spectrophotometer: Hewlett Packard 8452A Hydroperoxide: 30% $H_2O_2$ by weight in water Dibenzothiophene (DBT) in toluene: initial sulfur content 0.38% by weight as elemental sulfur Crude oil: Fancher Oil Co. crude from Wyoming; original sulfur content 3.33% by weight The DBT/toluene solution was combined with the aqueous $H_2O_2$, and a quaternary ammonium salt phase transfer agent and phosphotungstic acid were added. Ultrasound was applied for twenty minutes, and after extraction of the product mixture with acetonitrile the result was a reduction in the sulfur content from an initial level of 0.38% by weight to a final level of 0.15% by weight (60.5%) removal. A comparison of UV spectrum of the solution before the reaction with that of the product solution revealed two peaks in the former that were absent from the latter, indicating that the reaction has caused a significant change in the structure of the DBT in the sample. Gas chromatography analyses of the solutions both before and after indicated that the reaction had little or no change in the peak associate with the phase transfer agent, while the peak associated with the DBT peak in the reaction product was too small to be detected, visible only in the trace taken after the product mixture was concentrated. These results indicate high efficiency and high selectivity toward the oxidation of DBT.

In the crude oil tests, the total sample volume was 90 mL, with an oil:water volume ratio of 4:5. These tests were performed without the addition of a phase transfer agent, and with an ultrasonic intensity of 60%. In a first series of tests, only the oil and water were treated by ultrasound (with no hydroperoxide, phase transfer agents, or Fenton catalysts), and the ultrasound treatment time was varied between 2 minutes and ten minutes. The amount of sulfur in the sample, relative to the amount prior to any treatment, are shown in Table I below.

TABLE I

Sulfur Reduction vs. Ultrasound Time

| Ultrasound Time (min) | Sulfur Content (as % of Initial) | % Sulfur Reduction |
|---|---|---|
| 0 | 100.0 | 0 |
| 2 | 98.6 | 1.4 |
| 5 | 94.0 | 6.0 |
| 7.5 | 88.4 | 11.6 |
| 10 | 86.6 | 13.4 |

In a second series of tests, $H_2O_2$ was included in the reaction mixture at different concentrations ranging from 1.2% to 6%, and ultrasound time was limited to 5 minutes. The results are shown in Table II.

TABLE II

| Sulfur Reduction vs. $H_2O_2$ Concentration at 5 Minutes Ultrasound | | | |
|---|---|---|---|
| $H_2O_2$ (%) | $H_2O_2$ (mL) | Sulfur Content (as % of Initial) | % Sulfur Reduction |
| 0 | 0 | 94.0 | 6.0 |
| 1.2 | 2 | 87.4 | 12.6 |
| 2.4 | 4 | 80.5 | 19.5 |
| 3.6 | 6 | 79.9 | 20.1 |

In a third series of tests, different amounts of $H_2O_2$ were included and the ultrasound exposure time was increased to 7.5 minutes. The results are shown in Table III.

TABLE III

| Sulfur Reduction vs. $H_2O_2$ Concentration at 7.5 Minutes Ultrasound | | | |
|---|---|---|---|
| $H_2O_2$ (%) | $H_2O_2$ (mL) | Sulfur Content (as % of Initial) | % Sulfur Reduction |
| 0 | 0 | 88.4 | 11.6 |
| 1.2 | 2 | 76.6 | 23.4 |
| 1.8 | 3 | 68.6 | 31.4 |
| 2.4 | 4 | 57.2 | 42.8 |
| 3.0 | 5 | 90.2 | 9.8 |
| 3.6 | 6 | 86.2 | 13.8 |

In a fourth series of tests, a Fenton catalyst, $FeSO_4$, was included while the amount of $H_2O_2$ was again varied (ultrasound was applied for 7.5 minutes). The results are shown in Table IV.

TABLE IV

| Sulfur Reduction vs. $H_2O_2$ Concentration at 7.5 Minutes Ultasound in the Presence of Fe(II) Fenton Catalyst | | |
|---|---|---|
| $H_2O_2$ (%) | Sulfur Content (as % of Initial) | % Sulfur Reduction |
| 0 | 88.4 | 11.6 |
| 0.9 | 57.7 | 42.3 |
| 1.2 | 56.4 | 43.6 |
| 1.8 | 55.3 | 44.7 |
| 2.4 | 77.1 | 22.8 |

In a fifth series of tests, different types of Fenton catalysts were used, all at a concentration of 40 mM, with 2.4% $H_2O_2$ (4 mL) and 5 minutes of ultrasound. The results are shown in Table V.

TABLE V

| Sulfur Reduction vs. Different Fenton Catalysts Using 2.4% $H_2O_2$ and 5 Minutes Ultrasound | | | | |
|---|---|---|---|---|
| Catalyst: | $FeSO_4$ | $FeCl_2$ | $CuSO_4$ | $FeCl_3$ |
| % Sulfur Reduction: | 22.8 | 19.0 | 32.0 | 16.8 |

EXAMPLE 2

This example illustrates the effect of further variations on the process of the invention, including the use of different metallic catalysts and variations in the oil/water ratio, ultrasound intensity, temperature, ultrasound exposure time, amount of $H_2O_2$, and choice of catalyst. The materials and instrumentation were the same as those listed in Example 1.

A toluene solution of DBT was used, with $H_2O_2$ and quaternary ammonium salts and an ultrasound time of 7 minutes. Three types of catalyst were tested—a tungstate (phosphotungstic acid), a molybdate, and Fe(II). The percent sulfur removal with the tungstate catalyst was 74.6%, while the percent removal with each of the molybdate and Fe(II) catalysts was less than 5%. Further tests were then performed using the tungstate catalyst in different quantities. With a total reaction medium volume of 90 mL, 0.6 g of phosphotungstic acid produced 51.2% sulfur removal, 1.2 g produced 74.6% sulfur removal, and 2.5 g produced 70.1% sulfur removal. An infrared analysis was performed on the product, using a Model 5-DX-FTIR spectrometer system (Nicolet Inc.) with a Hewlett Packard 7475A plotter. According to standard IR spectra, the sulfone group has two strong bands near 1135 $cm^{-1}$ (asymmetric stretch) and 1300 $cm^{-1}$ (symmetric stretch), respectively. Both of these bands were evident in the product spectra, indicating that the solid product was indeed dibenzothiophene sulfone.

Samples of sour crude oil were then subjected to a series of tests, using distilled water. In the first of these series, the oil/water volume ratio was varied while ultrasound was applied for 7.5 minutes in each test and the temperature was allowed to rise to 90° C. The results are listed in Table VI.

TABLE VI

| Sulfur Reduction vs. Oil/Water Ratio at 7.5 Minutes Ultrasound | | |
|---|---|---|
| Oil/Water Ratio | Sulfur Content (as % of Initial) | % Sulfur Reduction |
| 2:5 | 85.4 | 14.6 |
| 3:5 | 83.2 | 16.8 |
| 4:5 | 88.4 | 11.6 |
| 5:5 | 85.4 | 14.6 |
| 7.5 | 88.1 | 11.9 |
| 5:3 | 87.5 | 12.5 |
| 6:3 | 77.0 | 23.0 |
| 7:3 | 92.4 | 7.6 |
| 8:3 | 94.9 | 5.1 |
| 9:3 | 91.6 | 8.4 |

In the second series, the ultrasound intensity was varied, using an oil/water volumetric ratio of 2:1, an ultrasound time of 7.5 minutes, and with the ultrasound chamber immersed in an ice-water coolant. The results are listed in Table VII.

TABLE VII

| Sulfur Reduction vs. Ultasound Intensity at 2:1 Oil/Water Ratio and 7.5 Minutes Ultasound | | | |
|---|---|---|---|
| Amplitude (%) | Intensity (watts/$cm^2$) | Sulfur Content (as % of Initial) | % Sulfur Reduction |
| 0 | 0 | 100.0 | 0 |
| 40 | 146.6 ± 7.5 | 70.2 | 29.8 |
| 50 | 157.9 ± 7.5 | 65.3 | 34.7 |
| 60 | 139.1 ± 7.5 | 62.9 | 37.1 |

In the third series, the temperature was varied, using an oil/water volumetric ratio of 2:1, an ultrasound time of 7.5 minutes, and an ultrasound amplitude of 50% (157.9±7.5 watts/$cm^2$). The results are listed in Table VIII. One test were performed at ambient conditions with no cooling system (designated "AMB" in the table), another with immersion of the ultrasound chamber in a cool water bath (designated "CLW" in the table), and a third with immersion of the ultrasound chamber in a ice-water bath (designated "ICW" in the table).

TABLE VIII

| Sulfur Reduction vs. Temperature | | | |
|---|---|---|---|
| Coolant | Chamber Temperature Range (° C.) | Sulfur Content (as % of Initial) | % Sulfur Reduction |
| AMB | 20–90 | 74.5 | 25.5 |
| CLW | 15–58 | 77.5 | 22.5 |
| ICW | 4–56 | 69.4 | 30.6 |

The fourth series varied the ultrasound time, using an ice-water cooling system and other conditions identical to those of the third series. The results are shown in Table IX.

TABLE IX

| Sulfur Reduction vs. Ultrasound Time | | |
|---|---|---|
| Ultrasound Time (min) | Sulfur Content (as % of Initial) | % Sulfur Reduction |
| 5 | 88.9 | 11.1 |
| 7.5 | 65.8 | 34.2 |
| 10 | 68.0 | 32.0 |
| 15 | 78.1 | 21.9 |

The fifth series varied the $H_2O_2$ concentration, using an ultrasound time of 7.5 minutes and other conditions identical to those of the fourth series. The results are shown in Table X.

TABLE X

| Sulfur Reduction vs. Ultrasound Time | | |
|---|---|---|
| $H_2O_2$ concentration (weight %) | Sulfur Content (as % of Initial) | % Sulfur Reduction |
| 0 | 65.8 | 34.2 |
| 1.5 | 72.7 | 27.3 |
| 2 | 62.0 | 38.0 |
| 2.4 | 64.5 | 35.5 |
| 3 | 65.0 | 35.0 |
| 4 | 63.1 | 36.9 |

The sixth series used metallic catalysts other than tungstates, with 2% $H_2O_2$, and 40 mM of the catalyst, other conditions being identical to those of the fifth series. The result are shown in Table XI.

TABLE XI

| Sulfur Reduction vs. Ultrasound Time | | |
|---|---|---|
| Catalyst | Sulfur Content (as % of Initial) | % Sulfur Reduction |
| (none) | 65.8 | 34.2 |
| $FeSO_4$ | 72.7 | 27.3 |
| $FeCl_2$ | 62.0 | 38.0 |
| $CuSO_4$ | 64.5 | 35.5 |
| $FeCl_3$ | 63.1 | 36.9 |

EXAMPLE 3

This example illustrates the effect of the process of the invention on three different sulfur compounds, dibenzothiophene (DBT), benzothiophene (BT), and thiophene. Each was tested as a toluene solution with an elemental sulfur content of 0.4% on a mass basis. In each case, a reactor vessel was charged with 20 g of the solution, plus 0.12 g of phosphotungstic acid, 0.1 g of tetraoctylammonium bromide, and 40 g of 30% (by volume) aqueous $H_2O_2$. The mixture was irradiated with ultrasound at a frequency of 20 kHz and an intensity of 50%, for 7 minutes, using coolant temperatures of 20° C. and 4° C. The materials and instrumentation used were the same as those listed in the preceding examples. The results in terms of percent sulfur removal are shown in Table XII.

TABLE XII

| Sulfur Reduction for Three Organic Sulfur Compounds | | | |
|---|---|---|---|
| Coolant | % Sulfur Reduction | | |
| Temperature | DBT | BT | Thiophene |
| 20° C. | 74.6 | 24.6 | <9.3 |
| 4° C. | (no data) | 48.6 | <10 |

The experiment was then repeated for DBT except that gasoline (with a sulfur content of 20 ppm) was used as the solvent in place of toluene. At 20° C. coolant temperature, the sulfur reduction was 98.4%, and at 4° C., the sulfur reduction was 99.2%.

EXAMPLE 4

This example illustrates the effect of various combinations of process variables on the sulfur reduction in crude oil according to the process of the invention. Five process parameters were varied, each at two levels, as follows:

TABLE XIII

| Process Variables | | |
|---|---|---|
| Process Variable | Level #1 | Level #2 |
| A. Oil/Water Volume Ratio | 0.8:1 | 2:1 |
| B. % $H_2O_2$ in Water | 2 | 4 |
| C. Ultrasound Time (min) | 7.5 | 15 |
| D. Use of $FeCl_2$ (40 mM) | no | yes |
| E. Use of Tween 80* (0.3%) | no | yes |

*Tween 80 is a surfactant consisting of polyoxyethylene (20) sorbitan mono-oleate Eight tests were then performed, using various combinations of these process variables, with an ultrasound amplitude of 50% and an ice-water coolant. The percent reduction in sulfur content was determined in each case, and the results are listed in Table XIV.

TABLE XIV

| Process Variables and Test Results | | | | | | |
|---|---|---|---|---|---|---|
| | Levels of Process Variables | | | | | % Sulfur |
| Test No. | A | B | C | D | E | Reduction |
| 1 | #1 | #1 | #1 | #2 | #2 | 0.5 |
| 2 | #1 | #1 | #2 | #2 | #1 | 29.5 |
| 3 | #1 | #2 | #1 | #1 | #2 | 3.0 |
| 4 | #2 | #1 | #1 | #1 | #1 | 19.7 |
| 5 | #2 | #2 | #1 | #2 | #1 | 35.5 |
| 6 | #2 | #1 | #2 | #1 | #2 | 37.2 |
| 7 | #1 | #2 | #2 | #1 | #1 | 18.0 |
| 8 | #2 | #2 | #2 | #2 | #2 | 38.3 |

EXAMPLE 5

This example illustrates the use of two different hydroperoxides, $H_2O_2$ and tert-butylhydroperoxide, in the process of the invention. The process was conducted on heavy crude oil, otherwise using the materials and instrumentation used in the preceding examples. Process parameters were as follows:

Oil/water volumetric ratio: 2:1

Total volume of oil/water mixture: 90 mL

Temperature control: by immersion in an ice-water cooling bath

Ultrasound amplitude: 50%

Ultrasound time: 7.5 min

Average ultrasound intensity: 111 watts/$cm^2$

Hydroperoxide (both $H_2O_2$ and tert-butylhydroperoxide) concentration: 2% by volume in water The degree of sulfur reduction was determined for each hydroperoxide and the results are listed in Table XV below.

TABLE XV

Sulfur Reduction Results Using Different Hydroperoxides

| Hydroperoxide: | $H_2O_2$ | tert-butylhydroperoxide |
|---|---|---|
| S reduction, %: | 79.8 | 62.8 |

EXAMPLE 6

This example illustrates the use of different surface active or phase transfer agents on the efficiency of the process of the invention. The process was conducted on a toluene solution of dibenzothiophene, and the materials and instrumentation used in the preceding examples were used, together with the optimum conditions indicated by those examples. The surface active agents were as follows:

dodecyltrimethyl ammonium bromide (DOB)

tetraoctyl ammonium bromide (TEB)

1-octanesulfonic acid, sodium salt

Span 20 (sorbitan monolaurate)

Tween 80 (polyoxyethylene 20 sorbitan mono-oleate)

Of these, only DOB and TEB enhanced the desulfurization process.

EXAMPLE 7

This example illustrates the application of the process of the invention to the desulfurization of diesel fuel. Both high-sulfur and low-sulfur diesel fuels were studied, the former having an initial sulfur content of 0.1867 weight % and the latter an initial sulfur content of 0.0190.

FIG. 1 is a schematic diagram of the process used for the high-sulfur diesel, comparing the results obtained with ultrasound against those obtained without the use of ultrasound. The notation "L/L Extraction" denotes liquid-liquid extraction using acetonitrile as the extracting solvent, and in each case three extractions were performed. The left side of the diagram shows the comparative process without the use of ultrasound, the three extractions resulting in sulfur contents of 0.1585%, 0.1361%, and 0.1170%, respectively. The right side shows the results of the same process performed with ultrasound, the three extractions resulting in sulfur contents of 0.0277%, 0.0076%, and 0.0049% (a final reduction of 97.4%), respectively.

Figure 2:
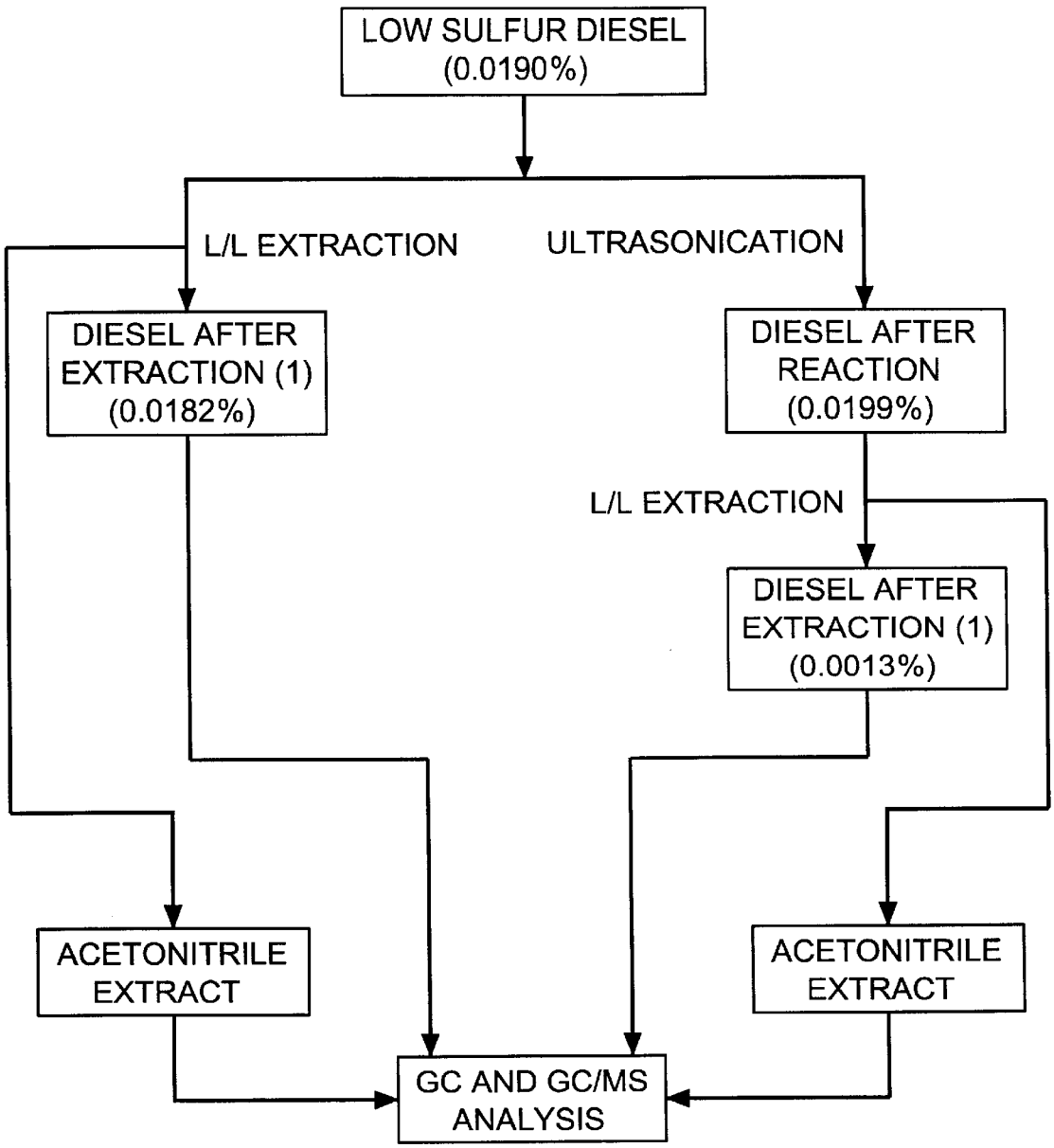
FIG. 2 is a schematic diagram of a desulfurization processes in accordance with the present invention for low-sulfur diesel.

FIG. 2 is a schematic diagram of the process used for the low-sulfur diesel, comparing the results obtained with ultrasound against those obtained without the use of ultrasound. The notation "L/L Extraction" denotes liquid-liquid extraction using acetonitrile as the extracting solvent, and in each case only one extraction was performed. The left side of the diagram shows the comparative process without the use of ultrasound, resulting in a sulfur content of 0.0182% after extraction. The right side shows the results of the same process performed with ultrasound, resulting in a sulfur content of 0.0013% (a final reduction of 93.2%) after extraction.

Figure 3:
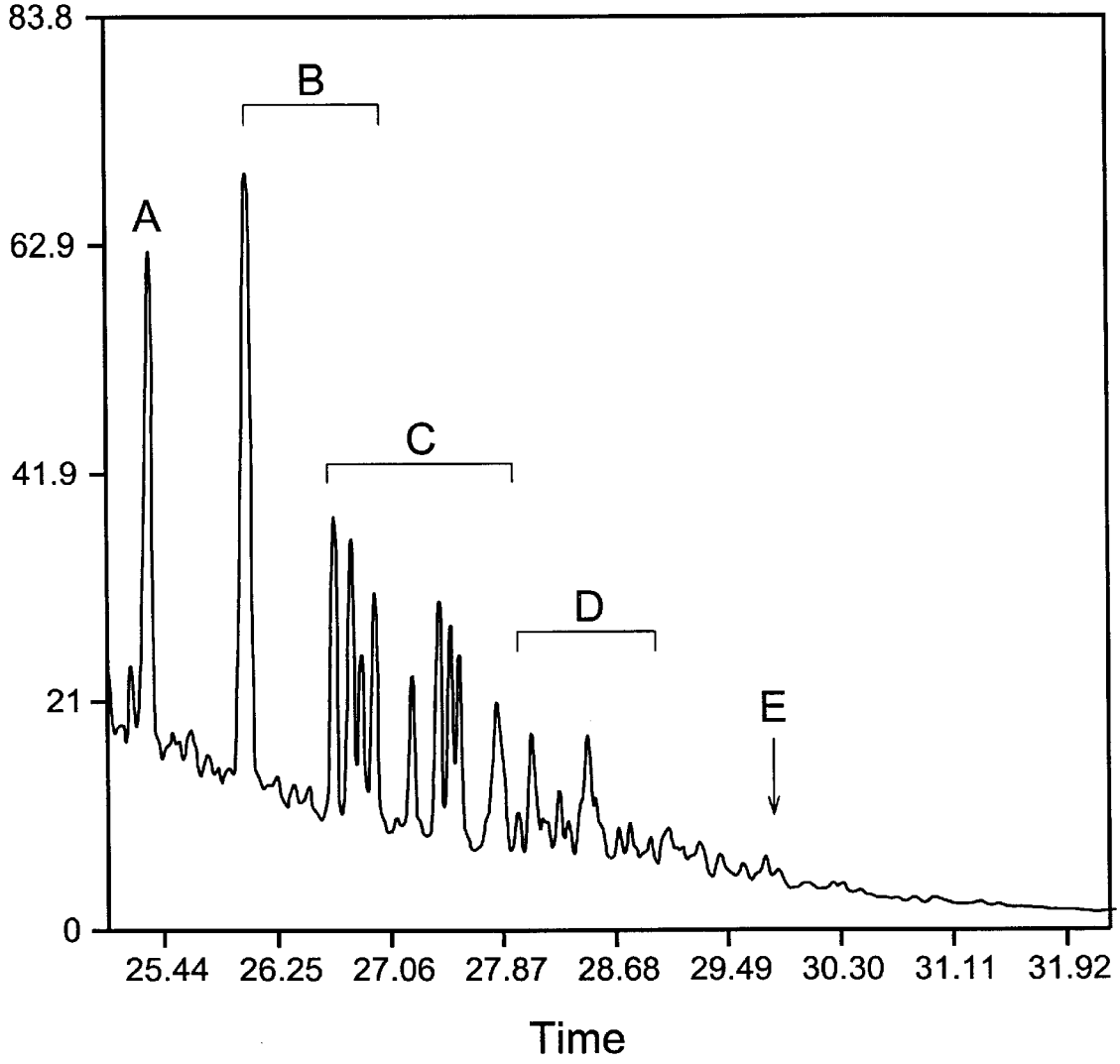
FIG. 3 is an ion chromatogram of a GC/MS analysis of the high-sulfur diesel fuel treated in accordance with the process of FIG. 1 combined with its acetonitrile extact.
Figure 4:
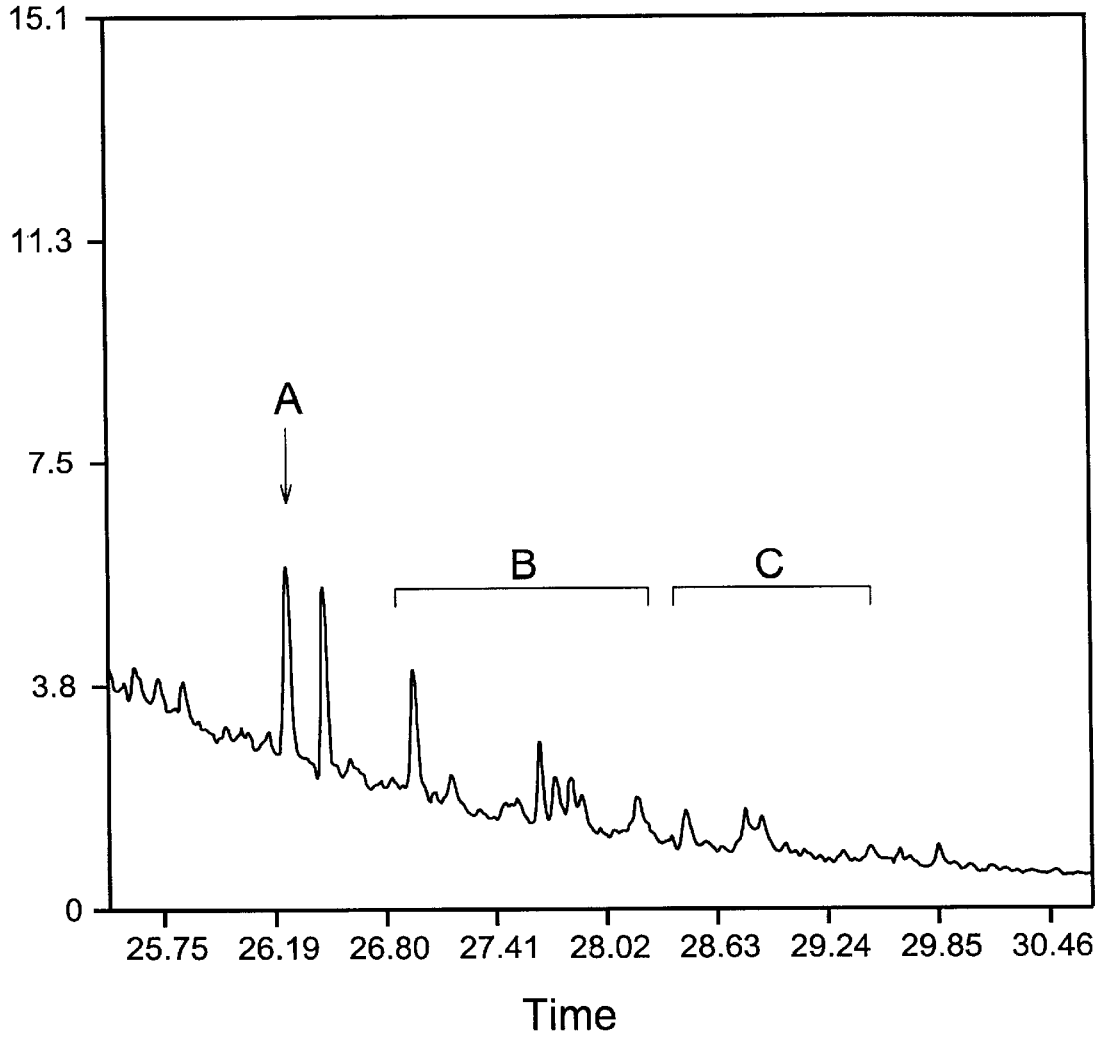
FIG. 4 is an ion chromatogram of a GC/MS analysis of the high-sulfur diesel fuel treated in accordance with the process of FIG. 2 combined with its acetonitrile extact.

FIGS. 3 and 4 are GC/MS scans of the high-sulfur diesel and the low-sulfur diesel, respectively, each combined with their respective acetonitrile extracts, resulting from the processes shown in FIGS. 1 and 2, each scan representing the ultrasound treated samples only. Each scan indicates that the DBT and most alkyl-substituted DBT's in both diesels have been converted to their corresponding sulfones.

The foregoing is offered primarily for purposes of illustration. Further variations in the materials, additives, operating conditions, and equipment that are still within the scope of the invention will be readily apparent to those skilled in the art.

We claim:

1. A method for removing sulfides from a liquid fossil fuel, said method comprising:

(a) combining said liquid fossil fuel with an acidic aqueous solution comprising water and a hydroperoxide to form a multiphase reaction medium, said acidic aqueous solution having a pH equal to that of a 1–30% by volume aqueous hydrogen peroxide solution;

(b) applying ultrasound to said multiphase reaction medium for a time sufficient to cause oxidation of sulfides in said fossil fuel to sulfones; and (c) extracting said sulfones to yield an organic phase that is substantially sulfone-free.

2. A method in accordance with claim 1 in which said hydroperoxide is a member selected from the group consisting of hydrogen peroxide and water-soluble alkylhydroperoxides.

3. A method in accordance with claim 1 in which said hydroperoxide is a member selected from the group consisting of hydrogen peroxide and tertiary-alkyl hydroperoxides.

4. A method in accordance with claim 1 in which said hydroperoxide is a member selected from the group consisting of hydrogen peroxide and tertiary-butyl hydroperoxide.

5. A method in accordance with claim 1 in which said hydroperoxide is hydrogen peroxide.

6. A method in accordance with claim 1 further comprising combining a phase transfer agent with said liquid fossil fuel and said acidic aqueous solution to form said multiphase reaction medium.

7. A method in accordance with claim 6 in which said phase transfer agent is a cationic phase transfer agent.

8. A method in accordance with claim 7 in which said cationic phase transfer agent is a quaternary ammonium salt.

9. A method in accordance with claim 8 in which said quaternary ammonium salt is a tetraalkylammonium halide.

10. A method in accordance with claim 1 in which step (a) comprises combining said liquid fossil fuel and said acidic aqueous solution at a (fossil fuel)(aqueous solution) volume ratio of from about 1:1 to about 1:3.

11. A method in accordance with claim 1 in which step (a) comprises combining said liquid fossil fuel and said acidic aqueous solution at a (fossil fuel)(aqueous solution) volume ratio of from about 1:1.5 to about 1:2.5.

12. A method in accordance with claim 1 in which step (b) is performed without heating said multiphase reaction medium from an external heat source.

13. A method in accordance with claim 1 in which step (b) is performed while cooling said multiphase reaction medium by thermal contact with a coolant medium at a temperature of 50° C. or less.

14. A method in accordance with claim 1 in which step (b) is performed while cooling said multiphase reaction medium by thermal contact with a coolant medium at a temperature of 20° C. or less.

15. A method in accordance with claim 1 in which step (b) is performed while cooling said multiphase reaction medium by thermal contact with a coolant medium at a temperature of from about −5° C. to about 20° C.

16. A method in accordance with claim 1 in which step (b) comprises applying said ultrasound at a frequency of from about 20 kHz to about 200 kHz.

17. A method in accordance with claim 1 in which step (b) comprises applying said ultrasound at a frequency of from about 20 kHz to about 200 kHz and an intensity of from about 30 watts/cm$^2$ to about 300 watts/cm$^2$.

18. A method in accordance with claim 1 in which step (b) comprises applying said ultrasound at a frequency of from about 20 kHz to about 50 kHz.

19. A method in accordance with claim 1 in which step (b) comprises applying said ultrasound at a frequency of from about 20 kHz to about 50 kHz and an intensity of from about 50 watts/cm$^2$ to about 100 watts/cm$^2$.

20. A method in accordance with claim 1 in which step (c) comprises (i) phase separating said multiphase reaction medium into organic and aqueous phases, and (ii) extracting said sulfones from said organic phase.

21. A method in accordance with claim 20 in which (i) comprises extracting said sulfones by liquid-liquid extraction with a polar solvent.

22. A method in accordance with claim 20 in which (i) comprises extracting said sulfones by solid-liquid extraction with a silica gel.

23. A method in accordance with claim 1 further comprising combining a catalytic amount of a metallic catalyst selected from the group consisting of iron (II), iron (III), copper (I), copper (II), chromium (III), and chromium (VI) compounds, and molybdates, tungstates, and vanadates with said liquid fossil fuel and said acidic aqueous solution to form said multiphase reaction medium.

24. A method in accordance with claim 23 in which said metallic catalyst is a member selected from the group consisting of iron (II), iron (III), and copper (II) compounds, and tungstates.

25. A method in accordance with claim 23 in which said metallic catalyst is a tungstate.

26. A method in accordance with claim 1 in which said liquid fossil fuel is a member selected from the group consisting of crude oil, shale oil, diesel fuel, gasoline, kerosene, liquefied petroleum gas, and petroleum residuum-based fuel oils.

27. A method in accordance with claim 1 in which said liquid fossil fuel is a member selected from the group consisting of diesel fuel, gasoline, kerosene, and petroleum residuum-based fuel oils.

28. A method in accordance with claim 1 in which said liquid fossil fuel is crude oil.

29. A method in accordance with claim 1 in which said liquid fossil fuel is diesel fuel.

30. A method in accordance with claim 1 in which said liquid fossil fuel is No. 6 fuel oil.

31. A method in accordance with claim 1 in which said liquid fossil fuel is a vacuum residuum of petroleum distillation.

32. A method in accordance with claim 1 in which said time of step (b) is less than twenty minutes.

33. A method in accordance with claim 1 in which said time of step (b) is less than ten minutes.

* * * * *